US005668926A

United States Patent [19]

Karaali et al.

[11] Patent Number: 5,668,926

[45] Date of Patent: Sep. 16, 1997

[54] METHOD AND APPARATUS FOR CONVERTING TEXT INTO AUDIBLE SIGNALS USING A NEURAL NETWORK

[75] Inventors: Orhan Karaali, Rolling Meadows; Gerald Edward Corrigan, Chicago; Ira Alan Gerson, Schaumburg, all of Ill.

[73] Assignee: Motorola, Inc., Schaumburg, Ill.

[21] Appl. No.: 622,237

[22] Filed: Mar. 22, 1996

Related U.S. Application Data

[63] Continuation of Ser. No. 234,330, Apr. 28, 1994, abandoned.

[51] Int. Cl.[6] ..... G10L 5/06

[52] U.S. Cl. ..... 704/232

[58] Field of Search ..... 395/2.11, 2.41, 395/2.68, 2.69, 2.76

[56] References Cited

U.S. PATENT DOCUMENTS

| | | | |
|---|---|---|---|
| 3,632,887 | 1/1972 | Leipp et al. | 381/52 |
| 3,704,345 | 11/1972 | Coker et al. | 381/52 |
| 5,041,983 | 8/1991 | Nakahara et al. | 395/2.79 |
| 5,163,111 | 11/1992 | Baji et al. | 395/2 |

OTHER PUBLICATIONS

Weijters et al, "Speech Synthesis with Artificial Neural Networks", Int'l Conf on Acoustics, Speech & Signal Processing, Mar. 28–Apr. 1, 1993, pp. 1764–1769 vol. 1.

Scordilis et al, "Text Processing for Speech Synthesis Using Parallel Distributed Models", 1989 IEEE Proc, Apr. 9–12 1989, pp. 765–769 vol. 2.

Tuerk et al, "The Development of a Connectionist Multiple Voice Text-to-Speech System", Int'l Conf on Acoustics Speech & Signal Processing, May 14–17 1991 pp. 749–752 vol. 2.

"Speech Synthesis with Artificial Neural Networks"; Ton Weijters, Johan Thole *1993 IEEE International Conference on Neural Networks*, San Francisco, CA Mar. 28–Apr. 1, vol. 3, pp. 1264–1269.

*Primary Examiner*—Allen R. MacDonald
*Assistant Examiner*—Susan Wieland
*Attorney, Agent, or Firm*—Darleen J. Stockley

[57] ABSTRACT

Text may be converted to audible signals, such as speech, by first training a neural network 106 using recorded audio messages 204. To begin the training, the recorded audio messages are converted into a series of audio frames 205 having a fixed duration 213. Then, each audio frame is assigned a phonetic representation 203 and a target acoustic representation 208, where the phonetic representation 203 is a binary word that represents the phone and articulation characteristics of the audio frame, while the target acoustic representation 208 is a vector of audio information such as pitch and energy. After training, the neural network 106 is used in conversion of text into speech. First, text that is to be convened is translated to a series of phonetic frames 401 of the same form as the phonetic representations 208 and having the fixed duration 213. Then the neural network produces acoustic representations in response to context descriptions 207 that include some of the phonetic frames 401. The acoustic representations are then converted into a speech wave form by a synthesizer 107.

32 Claims, 5 Drawing Sheets

METHOD AND APPARATUS FOR CONVERTING TEXT INTO AUDIBLE SIGNALS USING A NEURAL NETWORK

This is a continuation of application Ser. No. 08/234,330, filed Apr. 28, 1994 and now abandoned.

FIELD OF THE INVENTION

This invention relates generally to the field of converting text into audible signals, and in particular, to using a neural network to convert text into audible signals.

BACKGROUND OF THE INVENTION

Text-to-speech conversion involves converting a stream of text into a speech wave form. This conversion process generally includes the conversion of a phonetic representation of the text into a number of speech parameters. The speech parameters are then converted into a speech wave form by a speech synthesizer. Concatenative systems are used to convert phonetic representations into speech parameters. Concatenative systems store patterns produced by an analysis of speech that may be diphones or demisyllabes and concatenate the stored patterns adjusting their duration and smoothing transitions to produce speech parameters in response to the phonetic representation. One problem with concatenative systems is the large number of patterns that must be stored. Generally, over 1000 patterns must be stored in a concatenative system. In addition, the transition between stored patterns is not smooth. Synthesis-by-rule systems are also used to convert phonetic representations into speech parameters. The synthesis-by-role systems store target speech parameters for every possible phonetic representation. The target speech parameters are modified based on the transitions between phonetic representations according to a set of rules. The problem with synthesis-by-rule systems is that the transitions between phonetic representations are not natural, because the transition rules tend to produce only a few styles of transition. In addition, a large set of rules must be stored.

Neural networks are also used to convert phonetic representations into speech parameters. The neural network is trained to associate speech parameters with the phonetic representation of the text of recorded messages. The training results in a neural network with weights that represents the transfer function required to produce speech wave forms from phonetic representations. Neural networks overcome the large storage requirements of concatenative and synthesis-by-rule systems, since the knowledge base is stored in the weights rather than in a memory.

One neural network implementation used to convert a phonetic representation consisting of phonemes into speech parameters uses as its input a group or window of phonemes. The number of phonemes in the window is fixed and predetermined. The neural network generates several frames of speech parameters for the middle phoneme of the window, while the other phonemes in the window surrounding the middle phoneme provide a context for the neural network to use in determining the speech parameters. The problem with this implementation is that the speech parameters generated don't produce smooth transitions between phonetic representations and therefore the generated speech is not natural and may be incomprehensible.

Therefore a need exist for a text-to-speech conversion system that reduces storage requirements and provides smooth transitions between phonetic representations such that natural and comprehensible speech is produced.

BRIEF DESCRIPTION OF THE DRAWINGS

FIG. 2-1 and 2-2 illustrate a method for generating training data for a neural network to be used in conversion of text to audio in accordance with the present invention.

DESCRIPTION OF A PREFERRED EMBODIMENT

The present invention provides a method for converting text into audible signals, such as speech. This is accomplished by first training a neural network to associate text of recorded spoken messages with the speech of those messages. To begin the training, the recorded spoken messages are converted into a series of audio frames having a fixed duration. Then, each audio frame is assigned a phonetic representation and a target acoustic representation, where the phonetic representation is a binary word that represents the phone and articulation characteristics of the audio frame, while the target acoustic representation is a vector of audio information such as pitch and energy. With this information, the neural network is trained to produce acoustic representations from a text stream, such that text may be converted into speech.

Figure 1:
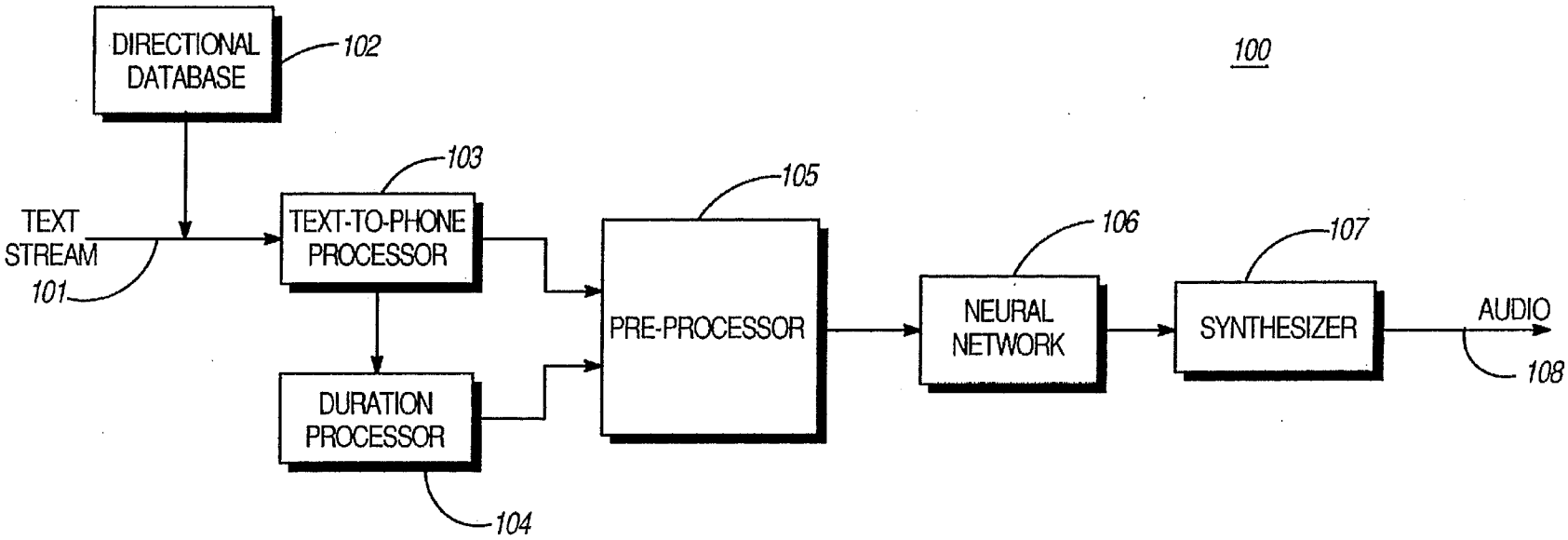
FIG. 1 illustrates a vehicular navigation system that uses text-to-audio conversion in accordance with the present invention.

The present invention is more fully described with reference to FIGS. 1–5. FIG. 1 illustrates a vehicular navigation system 100 that includes a directional database 102, text-to-phone processor 103, duration processor 104, pre-processor 105, neural network 106, and synthesizer 107. The directional database 102 contains a set of text messages representing street names, highways, landmarks, and other data that is necessary to guide an operator of a vehicle. The directional database 102 or some other source supplies a text stream 101 to the text-to-phone processor 103. The text-to-phone processor 103 produces phonetic and articulation characteristics of the text stream 101 that are supplied to the pre-processor 105. The pre-processor 105 also receives duration data for the text stream 101 from the duration processor 104. In response to the duration data and the phonetic and articulation characteristics, the pre-processor 105 produces a series of phonetic frames of fixed duration. The neural network 106 receives each phonetic frame and produces an acoustic representation of the phonetic frame based on its internal weights. The synthesizer 107 generates audio 108 in response to the acoustic representation generated by the neural network 106. The vehicular navigation system 100 may be implemented in software using a general purpose or digital signal processor.

The directional database 102 produces the text to be spoken. In the context of a vehicular navigation system, this may be the directions and information that the system is providing to guide the user to his or her destination. This input text may be in any language, and need not be a representation of the written form of the language. The input text may be a phonetic form of the language.

The text-to-phone processor 103 generally converts the text into a series of phonetic representations, along with descriptions of syntactic boundaries and prominence of syntactic components. The conversion to a phonetic representation and determination of prominence can be accomplished by a variety of means, including letter-to-sound rules and morphological analysis of the text. Similarly, techniques for determining syntactic boundaries include parsing of the text and simple insertion of boundaries based on the locations of punctuation marks and common function words, such as prepositions, pronouns, articles, and conjunctions. In the preferred implementation, the directional database 102 provides a phonetic and syntactic representation of the text, including a series of phones, a word category for each word, syntactic boundaries, and the prominence and stress of the syntactic components. The series of phones used are from Garafolo, John S., "The Structure And Format Of The DARPA TIMIT CD-ROM Prototype", National Institute Of Standards And Technology, 1988. The word category generally indicates the role of the word in the text stream. Words that are structural, such as articles, prepositions, and pronouns are categorized as functional. Words that add meaning versus structure are categorized as content. A third word category exist for sounds that are not a part of a word, i.e., silences and some glottal stops. The syntactic boundaries identified in the text stream are sentence boundaries, clause boundaries, phrase boundaries, and word boundaries. The prominence of the word is scaled as a value from 1 to 13, representing the least prominent to the most prominent, and the syllabic stress is classified as primary, secondary, unstressed or emphasized. In the preferred implementation, since the directional database stores a phonetic and syntactic representation of the text, the text-to-phone processor 103 simply passes that information to both the duration processor 104 and the pre-processor 105.

The duration processor 104 assigns a duration to each of the phones output from the text-to-phone processor 103. The duration is the time that the phone is being uttered. The duration may be generated by a variety of means, including neural networks and rule-based components. In the preferred implementation, the duration (D) for a given phone is generated by a rule-based component as follows: The duration is determined by equation (1) below:

$$D=d_{min}+t+(\lambda(d_{inherent}-d_{min})) \quad (1)$$

where $d_{min}$ is a minimum duration and $d_{inherent}$ is an inherent duration both selected from Table 1 below.

TABLE 1

| PHONE | $d_{min}$ (msec) | $d_{inherent}$ (msec) |
|---|---|---|
| aa | 185 | 110 |
| ae | 190 | 85 |
| ah | 130 | 65 |
| ao | 180 | 105 |
| aw | 185 | 110 |
| ax | 80 | 35 |
| axh | 80 | 35 |
| axr | 95 | 60 |
| ay | 175 | 95 |
| eh | 120 | 65 |
| er | 115 | 100 |
| ey | 160 | 85 |
| ih | 105 | 50 |
| ix | 80 | 45 |
| iy | 120 | 65 |
| ow | 155 | 75 |
| oy | 205 | 105 |
| uh | 120 | 45 |
| uw | 130 | 55 |

TABLE 1-continued

| PHONE | $d_{min}$ (msec) | $d_{inherent}$ (msec) |
|---|---|---|
| ux | 130 | 55 |
| el | 160 | 140 |
| hh | 95 | 70 |
| hv | 60 | 30 |
| l | 75 | 40 |
| r | 70 | 50 |
| w | 75 | 45 |
| y | 50 | 35 |
| em | 205 | 125 |
| en | 205 | 115 |
| eng | 205 | 115 |
| m | 85 | 50 |
| n | 75 | 45 |
| ng | 95 | 45 |
| dh | 55 | 5 |
| f | 125 | 75 |
| s | 145 | 85 |
| sh | 150 | 80 |
| th | 140 | 10 |
| v | 90 | 15 |
| z | 150 | 15 |
| zh | 155 | 45 |
| bcl | 75 | 25 |
| dcl | 75 | 25 |
| gcl | 75 | 15 |
| kcl | 75 | 55 |
| pcl | 85 | 50 |
| tcl | 80 | 35 |
| b | 10 | 5 |
| d | 20 | 10 |
| dx | 20 | 20 |
| g | 30 | 20 |
| k | 40 | 25 |
| p | 10 | 5 |
| t | 30 | 15 |
| ch | 120 | 80 |
| jh | 115 | 80 |
| q | 55 | 35 |
| nx | 75 | 45 |
| sil | 200 | 200 |
| epi | 30 | 30 |

The value for $\lambda$ is determined by the following rules:

If the phone is the nucleus, i.e., the vowel or syllabic consonant in the syllable, or follows the nucleus in the last syllable of a clause, and the phone is a retroflex, lateral, or nasal, then $$\lambda_1=\lambda_{initial}\times m_1$$

and $m_1=1.4$, else $$\lambda_1=\lambda_{initial}$$

If the phone is the nucleus or follows the nucleus in the last syllable of a clause and is not a retro flex, lateral, or nasal, then $$\lambda_2=\lambda_1 m_2$$

and $m_2=1.4$, else $$\lambda_2=\lambda_1$$

If the phone is the nucleus of a syllable which doesn't end a phrase, then $$\lambda_3=\lambda_2 m_3$$

and $m_3=0.6$, else $$\lambda_3=\lambda_2$$

If the phone is the nucleus of a syllable that ends a phrase and is not a vowel, then $\lambda_4=\lambda_3 m_4$ and $m_4=1.2$, else $\lambda_4=\lambda_3$ If the phone follows a vowel in the syllable that ends a phrase, then $\lambda_5=\lambda_4 m_5$ and $m_5=1.4$, else $\lambda_5=\lambda_4$ If the phone is the nucleus of a syllable that does not end a word, then $\lambda_6=\lambda_5 m_6$ and $m_6=0.85$, else $\lambda_6=\lambda_5$ If the phone is in a word of more than two syllables and is the nucleus of a syllable that does not end the word, then $\lambda_7=\lambda_6 m_7$ and $m_7=0.8$, else $\lambda_7=\lambda_6$ If the phone is a consonant that does not precede the nucleus of the first syllable in a word, then $\lambda_8=\lambda_7 m_8$ and $m_8=0.75$, else $\lambda_8=\lambda_7$ If the phone is in an unstressed syllable and is not the nucleus of the syllable, or follows the nucleus of the syllable it is in, then $\lambda_9=\lambda_8 m_9$ and $m_9=0.7$, unless the phone is a semivowel followed by a vowel, in which case then $\lambda_9=\lambda_8 m_{10}$ and $m_{10}=0.25$, else $\lambda_9=\lambda_8$ If the phone is the nucleus of a word-medial syllable that is unstressed or has secondary stress, then $\lambda_{10}=\lambda_9 m_{11}$ and $m_{11}=0.75$, else $\lambda_{10}=\lambda_9$ If the phone is the nucleus of a non-word-medial syllable that is unstressed or has secondary stress, then $\lambda_{11}=\lambda_{10} m_{12}$ and $m_{12}=0.7$, else $\lambda_{11}=\lambda_{10}$ If the phone is a vowel that ends a word and is in the last syllable of a phrase, then $\lambda_{12}=\lambda_{11} m_{13}$ and $m_{13}=1.2$, else $\lambda_{12}=\lambda_{11}$ If the phone is a vowel that ends a word and is not in the last syllable of a phrase, then $\lambda_{13}=\lambda_{12}(1-(m_{14}(1-m_{13})))$ and $m_{14}=0.3$, else $\lambda_{13}=\lambda_{12}$ If the phone is a vowel followed by a fricative in the same word and the phone is in the last syllable of a phrase, then $\lambda_{14}=\lambda_{13} m_{15}$ and $m_{15}=1.2$, else $\lambda_{14}=\lambda_{13}$ If the phone is a vowel followed by a fricative in the same word and the phone is not in the last syllable of a phrase, then $\lambda_{15}=\lambda_{14}(1-(m_{14}(1-m_{15})))$ else $\lambda_{15}=\lambda_{14}$ If the phone is a vowel followed by a closure in the same word and the phone is in the last syllable in a phrase, then $\lambda_{16}=\lambda_{15} m_{16}$ and $m_{16}=1.6$, else $\lambda_{16}=\lambda_{15}$ If the phone is a vowel followed by a closure in the same word and the phone is not in the last syllable in a phrase, then $\lambda_{17}=\lambda_{16}(1-(m_{14}(1-m_{16})))$ else $\lambda_{17}=\lambda_{16}$ If the phone is a vowel followed by a nasal and the phone is in the last syllable in a phrase, then $\lambda_{17}=\lambda_{16} m_{17}$ and $m_{17}=1.2$, else $\lambda_{17}=\lambda_{16}$ If the phone is a vowel followed by a nasal and the phone is not in the last syllable in a phrase, then $\lambda_{18}=\lambda_{17}(1-(m_{14}(1-m_{17})))$ else $\lambda_{18}=\lambda_{17}$ If the phone is a vowel which is followed by a vowel, then $$\lambda_{19}=\lambda_{18}m_{18}$$

and $m_{18}=1.4$, else $$\lambda_{19}=\lambda_{18}$$

If the phone is a vowel which is preceded by a vowel, then $$\lambda_{20}=\lambda_{19}m_{19}$$

and $m_{19}=0.7$, else $$\lambda_{20}=\lambda_{19}$$

If the phone is an 'n' which is preceded by a vowel in the same word and followed by an unstressed vowel in the same word, then $$\lambda_{21}=\lambda_{20}m_{20}$$

and $m_{20}=0.1$, else $$\lambda_{21}=\lambda_{20}$$

If the phone is a consonant preceded by a consonant in the same phrase and not followed by a consonant in the same phrase, then $$\lambda_{22}=\lambda_{21}m_{21}$$

and $m_{21}=0.8$, unless the consonants have the same place of articulation, m which case then $$\lambda_{22}=\lambda_{21}m_{21}m_{22}$$

and $m_{22}=0.7$, else $$\lambda_{22}=\lambda_{21}$$

If the phone is a consonant not preceded by a consonant in the same phrase and followed by a consonant in the same phrase, then $$\lambda_{23}=\lambda_{22}m_{23}$$

and $m_{23}=0.7$. unless the consonants have the same place of articulation, m which case then $$\lambda_{23}=\lambda_{22}m_{22}m_{23}$$

else $$\lambda_{23}=\lambda_{22}$$

If the phone is a consonant preceded by a consonant in the same phrase and followed by a consonant in the same phrase, then $$\lambda=\lambda_{23}m_{24}$$

and $m_{24}=0.5$. unless the consonants have the same place of articulation, in which case then $$\lambda=\lambda_{23}m_{22}m_{24}$$

else $$\lambda=\lambda_{23}$$

The value t is determined as follows:

If the phone is a stressed vowel which is preceded by an unvoiced release or affricate, then t=25 milliseconds, otherwise t=0.

In addition, if the phone is in an unstressed syllable, or the phone is placed after the nucleus of the syllable it is in, the minimum duration $d_{min}$,is cut in half before it is used in equation (1).

The preferred values for $d_{min}$, $d_{inherent}$, t, and $m_1$ through m24 were determined using standard numerical techniques to minimize the mean square differences of the durations calculated using equation (1) and actual durations from a database of recorded speech. The value for $\lambda_{initial}$ was selected to be 1 during the determination of $d_{min}$, $d_{inherent}$, $t_1$, and $m_1$ through m24. However, during the actual conversion of text-to-speech, the preferred value for slower more understandable speech is $\lambda_{initial}=1.4$.

The pre-processor 105 converts the output of the duration processor 104 and the text-to-phone processor 103 to appropriate input for the neural network 106. The pre-processor 105 divides time up into a series of fixed-duration frames and assigns each frame a phone which is nominally being uttered during that frame. This is a straightforward conversion from the representation of each phone and its duration as supplied by the duration processor 104. The period assigned to a frame will fall into the period assigned to a phone. That phone is the one nominally being uttered during the frame. For each of these frames, a phonetic representation is generated based on the phone nominally being uttered. The phonetic representation identifies the phone and the articulation characteristics associated with the phone. Tables 2-a through 2-f below list the sixty phones and thirty-six articulation characteristics used in the preferred implementation. A context description for each frame is also generated, consisting of the phonetic representation of the frame, the phonetic representations of other frames in the vicinity of the frame, and additional context data indicating syntactic boundaries, word prominence, syllabic stress and the word category. In contrast to the prior art, the context description is not determined by the number of discrete phones, but by the number of frames, which is essentially a measure of time. In the preferred implementation, phonetic representations for fifty-one frames centered around the frame under consideration are included in the context description. In addition, the context data, which is derived from the output of the text-to-phone processor 103 and the duration processor 104, includes six distance values indicating the distance in time to the middle of the three preceding and three following phones, two distance values indicating the distance in time to the beginning and end of the current phone, eight boundary values indicating the distance in time to the preceding and following word, phrase, clause and sentence; two distance values indicating the distance in time to the preceding and following phone; six duration values indicating the durations of the three preceding and three following phones; the duration of the present phone; fifty-one values indicating word prominence of each of the fifty-one phonetic representations; fifty-one values indicating the word category for each of the fifty-one phonetic representations; and fifty-one values indicating the syllabic stress of each of the fifty-one frames.

TABLE 2-a

| Phone | Vowel | Semivowel | Nasal | Fricative | Closure | Release | Affricate | Flap | Silence |
|---|---|---|---|---|---|---|---|---|---|
| aa | x | | | | | | | | |
| ae | x | | | | | | | | |
| ah | x | | | | | | | | |
| ao | x | | | | | | | | |
| aw | x | | | | | | | | |
| ax | x | | | | | | | | |
| axh | x | | | | | | | | |
| axr | x | | | | | | | | |
| ay | x | | | | | | | | |
| eh | x | | | | | | | | |
| er | x | | | | | | | | |
| ey | x | | | | | | | | |
| ih | x | | | | | | | | |
| ix | x | | | | | | | | |
| iy | x | | | | | | | | |
| ow | x | | | | | | | | |
| oy | x | | | | | | | | |
| uh | x | | | | | | | | |
| uw | x | | | | | | | | |
| ux | x | | | | | | | | |

| Phone | Low | Mid | High | Front | Back | Tense | Lax | Schwa | W-glide |
|---|---|---|---|---|---|---|---|---|---|
| aa | x | | | | x | x | | | |
| ae | x | | | x | | | x | | |
| ah | | x | | | x | | x | | |
| ao | | x | | | x | | x | | |
| aw | x | | | | x | x | | | x |
| ax | | x | | | x | | x | x | |
| axh | | x | | | x | | x | x | |
| axr | | x | | | x | | x | x | |
| ay | x | | | | x | x | | | |
| eh | | x | | x | | | x | | |
| er | | x | | | x | x | | | |
| ey | | x | | x | | x | | | |
| ih | | | x | x | | | x | | |
| ix | | | x | x | | | x | x | |
| iy | | | x | x | | x | | | |
| ow | | x | | | x | x | | | x |
| oy | | x | | | x | x | | | |
| uh | | | x | | x | | x | | |
| uw | | | x | | x | x | | | x |
| ux | | | x | x | | x | | | x |

TABLE 2-b

| Phone | Vowel | Semivowel | Nasal | Fricative | Closure | Release | Affricate | Flap | Silence |
|---|---|---|---|---|---|---|---|---|---|
| el | | x | | | | | | | |
| hh | | x | | | | | | | |
| hv | | x | | | | | | | |
| l | | x | | | | | | | |
| r | | x | | | | | | | |
| w | | x | | | | | | | |
| y | | x | | | | | | | |
| em | | | x | | | | | | |
| en | | | x | | | | | | |
| eng | | | x | | | | | | |
| m | | | x | | | | | | |
| n | | | x | | | | | | |
| ng | | | x | | | | | | |
| f | | | | x | | | | | |
| v | | | | x | | | | | |
| th | | | | x | | | | | |
| dh | | | | x | | | | | |
| s | | | | x | | | | | |
| z | | | | x | | | | | |
| sh | | | | x | | | | | |

TABLE 2-b-continued

| Phone | Low | Mid | High | Front | Back | Tense | Lax | Schwa | W-glide |
|---|---|---|---|---|---|---|---|---|---|
| el | | | | | | | | | |
| hh | | | | | | | | | |
| hv | | | | | | | | | |
| l | | | | | | | | | |
| r | | | | | | | | | |
| w | | | x | | x | | | | |
| y | | | x | x | | | | | |
| em | | | | | | | | | |
| en | | | | | | | | | |
| eng | | | | | | | | | |
| m | | | | | | | | | |
| n | | | | | | | | | |
| ng | | | | | | | | | |
| f | | | | | | | | | |
| v | | | | | | | | | |
| th | | | | | | | | | |
| dh | | | | | | | | | |
| s | | | | | | | | | |
| z | | | | | | | | | |
| sh | | | | | | | | | |

TABLE 2-c

| Phone | Vowel | Semivowel | Nasal | Fricative | Closure | Release | Affricate | Flap | Silence |
|---|---|---|---|---|---|---|---|---|---|
| zh | | | | x | | | | | |
| pcl | | | | | x | | | | |
| bcl | | | | | x | | | | |
| tcl | | | | | x | | | | |
| dcl | | | | | x | | | | |
| kcl | | | | | x | | | | |
| gcl | | | | | x | | | | |
| q | | | | | x | | | | |
| p | | | | | | x | | | |
| b | | | | | | x | | | |
| t | | | | | | x | | | |
| d | | | | | | x | | | |
| k | | | | | | x | | | |
| g | | | | | | x | | | |
| ch | | | | | | | x | | |
| jh | | | | | | | x | | |
| dx | | | | | | | | x | |
| nx | | | x | | | | | x | |
| sil | | | | | | | | | x |
| epi | | | | | | | | | x |

| Phone | Low | Mid | High | Front | Back | Tense | Lax | Schwa | W-glide |
|---|---|---|---|---|---|---|---|---|---|
| zh | | | | | | | | | |
| pcl | | | | | | | | | |
| bcl | | | | | | | | | |
| tcl | | | | | | | | | |
| dcl | | | | | | | | | |
| kcl | | | | | | | | | |
| gcl | | | | | | | | | |
| q | | | | | | | | | |
| p | | | | | | | | | |
| b | | | | | | | | | |
| t | | | | | | | | | |
| d | | | | | | | | | |
| k | | | | | | | | | |
| g | | | | | | | | | |
| xh | | | | | | | | | |
| jh | | | | | | | | | |
| dx | | | | | | | | | |
| nx | | | | | | | | | |
| sil | | | | | | | | | |
| epi | | | | | | | | | |

TABLE 2-d

| Phone | Y-glide | Centering | Labial | Dental | Alveolar | Palatal | Velar | Glottal | Retroflex |
|---|---|---|---|---|---|---|---|---|---|
| aa | | | | | | | | | |
| ae | | x | | | | | | | |
| ah | | | | | | | | | |
| ao | | x | | | | | | | |
| aw | | | | | | | | | |
| ax | | | | | | | | | |
| axh | | | | | | | | | |
| axr | | | | | | | | | x |
| ay | x | | | | | | | | |
| eh | | x | | | | | | | |
| er | | x | | | | | | | x |
| ey | x | | | | | | | | |
| ih | | x | | | | | | | |
| ix | | | | | | | | | |
| iy | x | | | | | | | | |
| ow | | | | | | | | | |
| oy | x | | | | | | | | |
| uh | | x | | | | | | | |
| uw | | | | | | | | | |
| ux | | | | | | | | | |

| Phone | Round | F2back | Lateral | Sonorant | Voiced | Aspirated | Stop | Artifact | Syllabic |
|---|---|---|---|---|---|---|---|---|---|
| aa | | | | x | x | | | | x |
| ae | | | | x | x | | | | x |
| ah | | | | x | x | | | | x |
| ao | x | | | x | x | | | | x |
| aw | | | | x | x | | | | x |
| ax | | | | x | x | | | | x |
| axh | | | | x | | x | | | x |
| axr | | | | x | x | | | | x |
| ay | | | | x | x | | | | x |
| eh | | | | x | x | | | | x |
| er | | | | x | x | | | | x |
| ey | | | | x | x | | | | x |
| ih | | | | x | x | | | | x |
| ix | | | | x | x | | | | x |
| iy | | x | | x | x | | | | x |
| ow | x | | | x | x | | | | x |
| oy | x | | | x | x | | | | x |
| uh | x | | | x | x | | | | x |
| uw | x | | | x | x | | | | x |
| ux | x | | | x | x | | | | x |

TABLE 2-e

| Phone | Y-glide | Centering | Labial | Dental | Alveolar | Palatal | Velar | Glottal | Retroflex |
|---|---|---|---|---|---|---|---|---|---|
| el | | | | | | | | | |
| hh | | | | | | | | x | |
| hv | | | | | | | | x | |
| l | | | | | | | | | |
| r | | | | | | | | | x |
| w | | | x | | | | | | |
| y | | | | | | x | | | |
| em | | | x | | | | | | |
| en | | | | | x | | | | |
| eng | | | | | | | x | | |
| m | | | x | | | | | | |
| n | | | | | x | | | | |
| ng | | | | | | | x | | |
| f | | | x | | | | | | |
| v | | | x | | | | | | |
| th | | | | x | | | | | |
| dh | | | | x | | | | | |
| s | | | | | x | | | | |
| z | | | | | x | | | | |
| sh | | | | | | x | | | |

TABLE 2-e-continued

| Phone | Round | F2back | Lateral | Sonorant | Voiced | Aspirated | Stop | Artifact | Syllabic |
|---|---|---|---|---|---|---|---|---|---|
| el | | | x | x | x | | | | x |
| hh | | | | x | | x | | | |
| hv | | | | x | x | x | | | |
| l | | | x | x | x | | | | |
| r | | | | x | x | | | | |
| w | x | | | x | x | | | | |
| y | | x | | x | x | | | | |
| em | | | | x | x | | | | x |
| en | | | | x | x | | | | x |
| eng | | | | x | x | | | | x |
| m | | | | x | x | | | | |
| n | | | | x | x | | | | |
| ng | | | | x | x | | | | |
| f | | | | | | | | | |
| v | | | | | x | | | | |
| th | | | | | | | | | |
| dh | | | | | x | | | | |
| s | | | | | | | | | |
| z | | | | | x | | | | |
| sh | | | | | | | | | |

TABLE 2-f

| Phone | Y-glide | Centering | Labial | Dental | Alveolar | Palatal | Velar | Glottal | Retroflex |
|---|---|---|---|---|---|---|---|---|---|
| zh | | | | | | x | | | |
| pcl | | | x | | | | | | |
| bcl | | | x | | | | | | |
| tcl | | | | | x | | | | |
| dcl | | | | | x | | | | |
| kcl | | | | | | | x | | |
| gcl | | | | | | | x | | |
| q | | | | | | | | x | |
| p | | | x | | | | | | |
| b | | | x | | | | | | |
| t | | | | | x | | | | |
| d | | | | | x | | | | |
| k | | | | | | | x | | |
| g | | | | | | | x | | |
| ch | | | | | | x | | | |
| jh | | | | | | x | | | |
| dx | | | | | x | | | | |
| nx | | | | | x | | | | |
| sil | | | | | | | | | |
| epi | | | | | | | | | |

| Phone | Round | F2back | Lateral | Sonorant | Voiced | Aspirated | Stop | Artifact | Syllabic |
|---|---|---|---|---|---|---|---|---|---|
| zh | | | | | x | | | | |
| pcl | | | | | | | x | | |
| bcl | | | | | x | | x | | |
| tcl | | | | | | | x | | |
| dcl | | | | | x | | x | | |
| kcl | | | | | | | x | | |
| gcl | | | | | x | | x | | |
| q | | | | | | | x | x | |
| p | | | | | | | | | |
| b | | | | | x | | | | |
| t | | | | | | | | | |
| d | | | | | x | | | | |
| k | | | | | | | | | |
| g | | | | | x | | | | |
| ch | | | | | | | | | |
| jh | | | | | x | | | | |
| dx | | | | | x | | | | |
| nx | | | | x | x | | | | |
| sil | | | | | | | | | |
| epi | | | | | | | | x | |

The neural network 106 accepts the context description supplied by the pre-processor 105 and based upon its internal weights, produces the acoustic representation needed by the synthesizer 107 to produce a frame of audio. The neural network 106 used in the preferred implementation is a four layer recurrent feed-forward network. It has 6100 processing elements (PEs) at the input layer, 50 PEs at the first hidden layer, 50 PEs at the second hidden layer, and 14 PEs at the output layer. The two hidden layers Use sigmoid transfer functions and the input and output layers use linear transfer functions. The input layer is subdivided into 4896 PEs for the fifty-one phonetic representations, where each phonetic representation uses 96 PEs; 140 PEs for recurrent inputs, i.e., the ten past output states of the 14 PEs at the output layer; and 1064 PEs for the context data. The 1064 PEs used for the context data are subdivided such that 900 PEs are used to accept the six distance values indicating the distance in time to the middle of the three preceding and three following phones, the two distance values indicating the distance in time to the beginning and end of the current phone, the six duration values indicating the durations of the three preceding and three following phones, and the duration of the present phone; 8 PEs are used to accept the eight boundary values indicating the distance in time to the preceding and following word, phrase, clause and sentence; 2 PEs are used for the two distance values indicating the distance in time to the preceding and following phone; 1 PE is used for the duration of the present phone; 51 PEs are used for the fifty-one values indicating word prominence of each of the fifty-one phonetic representations; 51 PEs are used for the fifty-one values indicating the word category for each of the fifty-one phonetic representations; and 51 PEs are used for the fifty-one values indicating the syllabic stress of each of the fifty-one frames. The 900 PEs used to accept the six distance values indicating the distance in time to the middle of the three preceding and three following phones, the two distance values indicating the distance in time to the beginning and end of the current phone, the six duration values, and the duration of the present phone are arranged such that a PE is dedicated to every value on a per phone basis. Since there are 60 possible phones and 15 values, i.e., the six distance values indicating the distance in time to the middle of the three preceding and three following phones, the two distance values indicating the distance in time to the beginning and end of the current phone, the six duration values, and the duration of the present phone, there are 900 PEs needed. The neural network 106 produces an acoustic representation of speech parameters that are used by the synthesizer 107 to produce a frame of audio. The acoustic representation produced in the preferred embodiment consist of fourteen parameters that are pitch; energy; estimated energy due to voicing; a parameter, based on the history of the energy value, which affects the placement of the division between the voiced and unvoiced frequency bands; and the first ten log area ratios derived from a linear predictive coding (LPC) analysis of the frame.

The synthesizer 107 converts the acoustic representation provided by the neural network 106 into an audio signal. Techniques that may be used for this include formant synthesis, multi-band excitation synthesis, and linear predictive coding. The method used in the preferred embodiment is LPC, with a variation in the excitation of an autoregressive filter that is generated from log area ratios supplied by the neural network. The autoregressive filter is excited using a two-band excitation scheme with the low frequencies having voiced excitation at the pitch supplied by the neural network and the high frequencies having unvoiced excitation. The energy of the excitation is supplied by the neural network. The cutoff frequency below which voiced excitation is used is determined by the following equation:

$$f_{cutoff} = 8000\left(1 - \frac{1 - \frac{VE}{E}}{\left(0.35 + \frac{3.5P}{8000}\right)K}\right) + 2P \tag{2}$$

where $f_{cutoff}$ is the cutoff frequency in Hertz, VE is the voicing energy, E is the energy, P is the pitch, and K is a threshold parameter. The values for VE, E, P, and K are supplied by the neural network 106. VE is a biased estimate of the energy in the signal due to voiced excitation and K is a threshold adjustment derived from the history of the energy value. The pitch and both energy values are scaled logarithmically in the output of the neural network 106. The cutoff frequency is adjusted to the nearest frequency that can be represented as (3n+½)P for some integer n, as the voiced or unvoiced decision is made for bands of three harmonics of the pitch. In addition, if the cutoff frequency is greater than 35 times the pitch frequency, the excitation is entirely voiced.

Figures 1, 2:
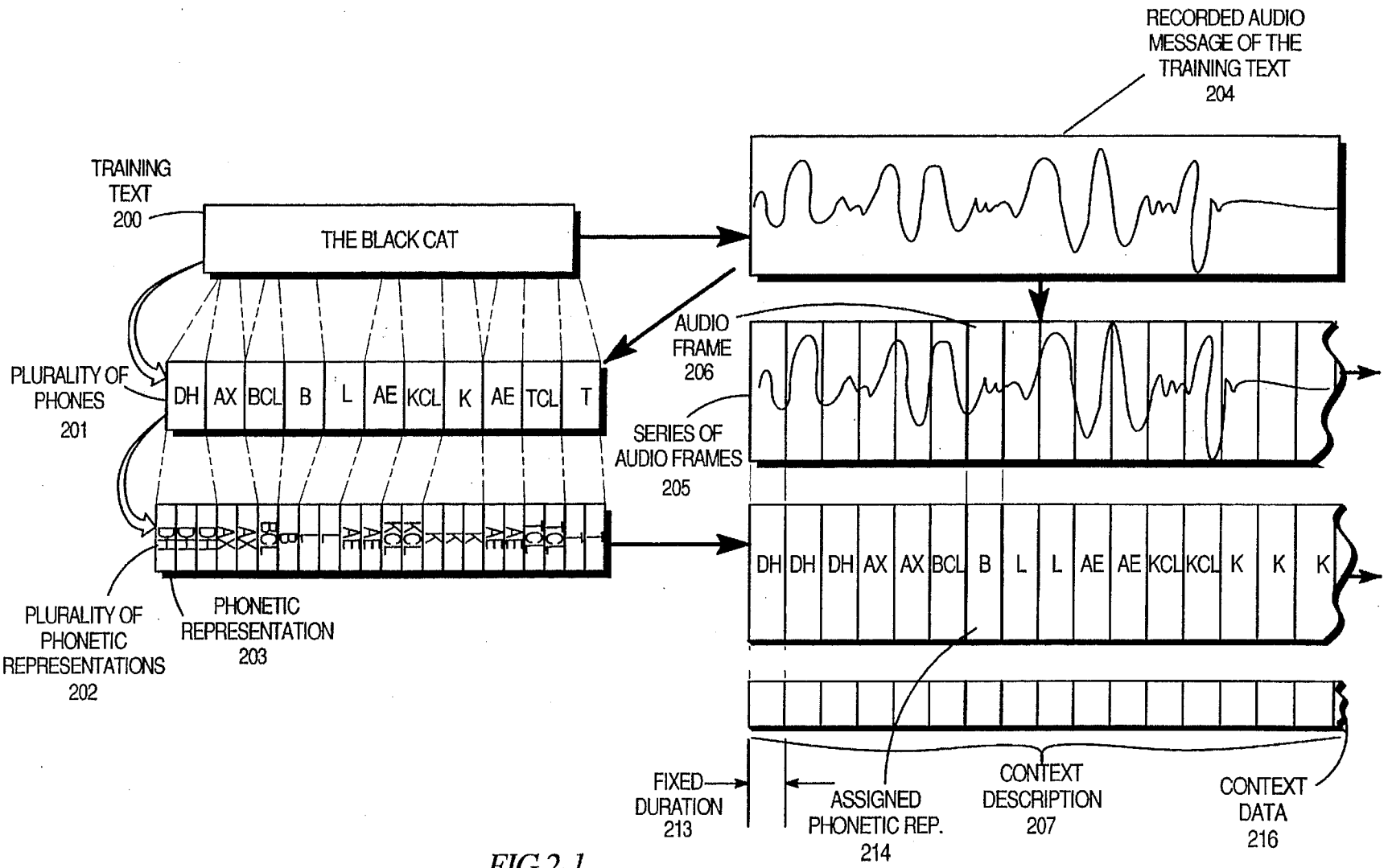
Figure 2:
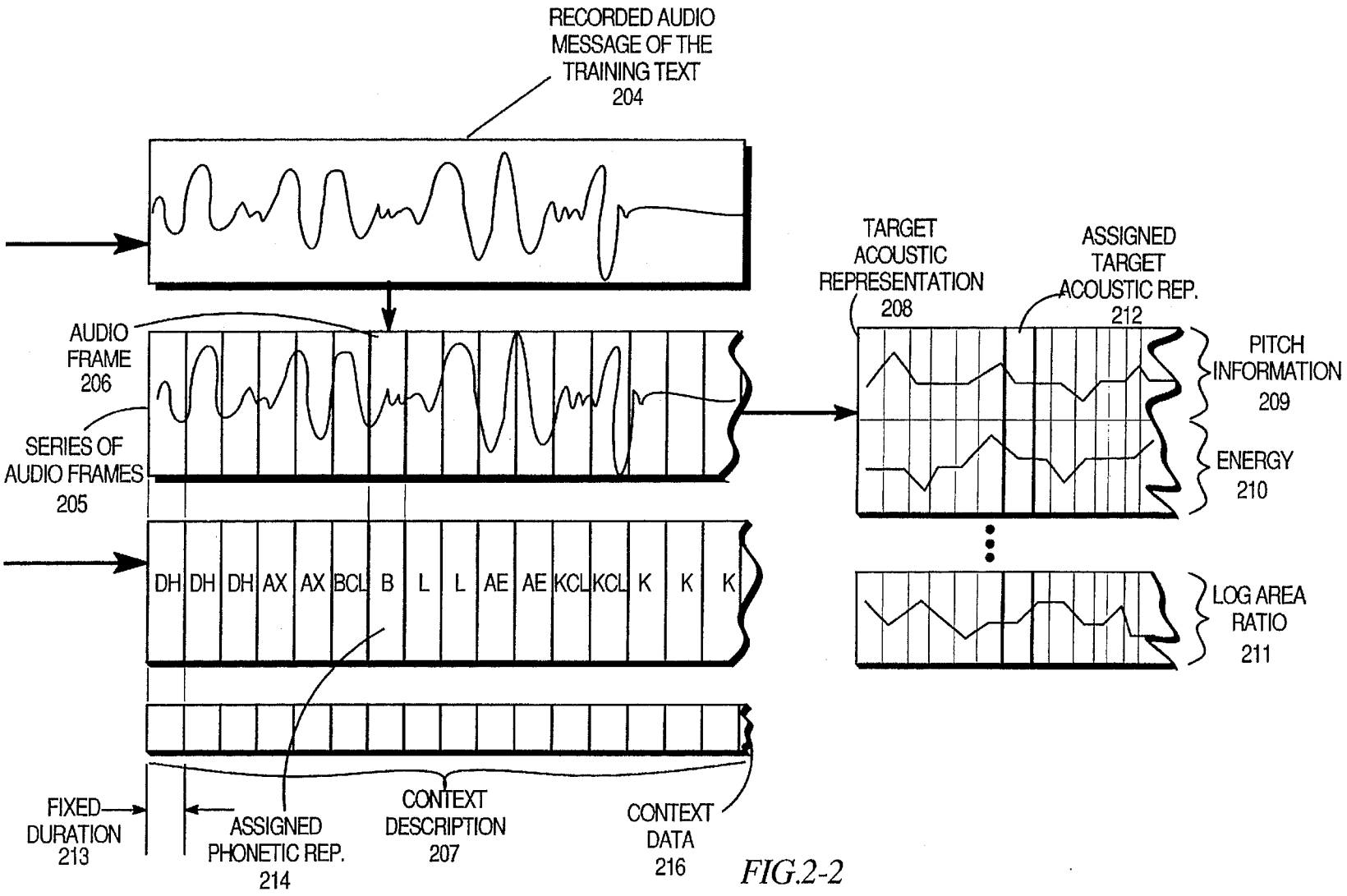

FIG. 2-1 and 2-2 demonstrate pictorially how the target acoustic representations 208 used in training the neural network are generated from the training text 200. The training text 200 is spoken and recorded generating a recorded audio message of the training text 204. The training text 200 is then transcribed to a phonetic form and the phonetic form is time aligned with the recorded audio message of the training text 204 to produce a plurality of phones 201, where the duration of each phone in the plurality of phones varies and is determined by the recorded audio message 204. The recorded audio message is then divided into a series of audio frames 205 with a fixed duration 213 for each audio frame. The fixed duration is preferably 5 milliseconds. Similarly, the plurality of phones 201 is converted into a series of phonetic representations 202 with the same fixed duration 213 so that for each audio frame there is a corresponding phonetic representation. In particular, the audio frame 206 corresponds to the assigned phonetic representation 214. For the audio frame 206 a context description 207 is also generated including the assigned phonetic representation 214 and the phonetic representations for a number of audio frames on each side of the audio frame 206. The context description 207 may preferably include context data 216 indicating syntactic boundaries, word prominence, syllabic stress and the word category. The series of audio frames 205 is encoded using an audio or speech coder, preferably a linear predictive coder, to produce a series of target acoustic representations 208 so that for each audio frame there is a corresponding assigned target acoustic representation. In particular, the audio frame 206 corresponds with the assigned target acoustic representation 212. The target acoustic representations 208 represent the output of the speech coder and may consist of a series of numeric vectors describing characteristics of the frame such as pitch 209, the energy of the signal 210 and a log area ratio 211.

Figure 3:
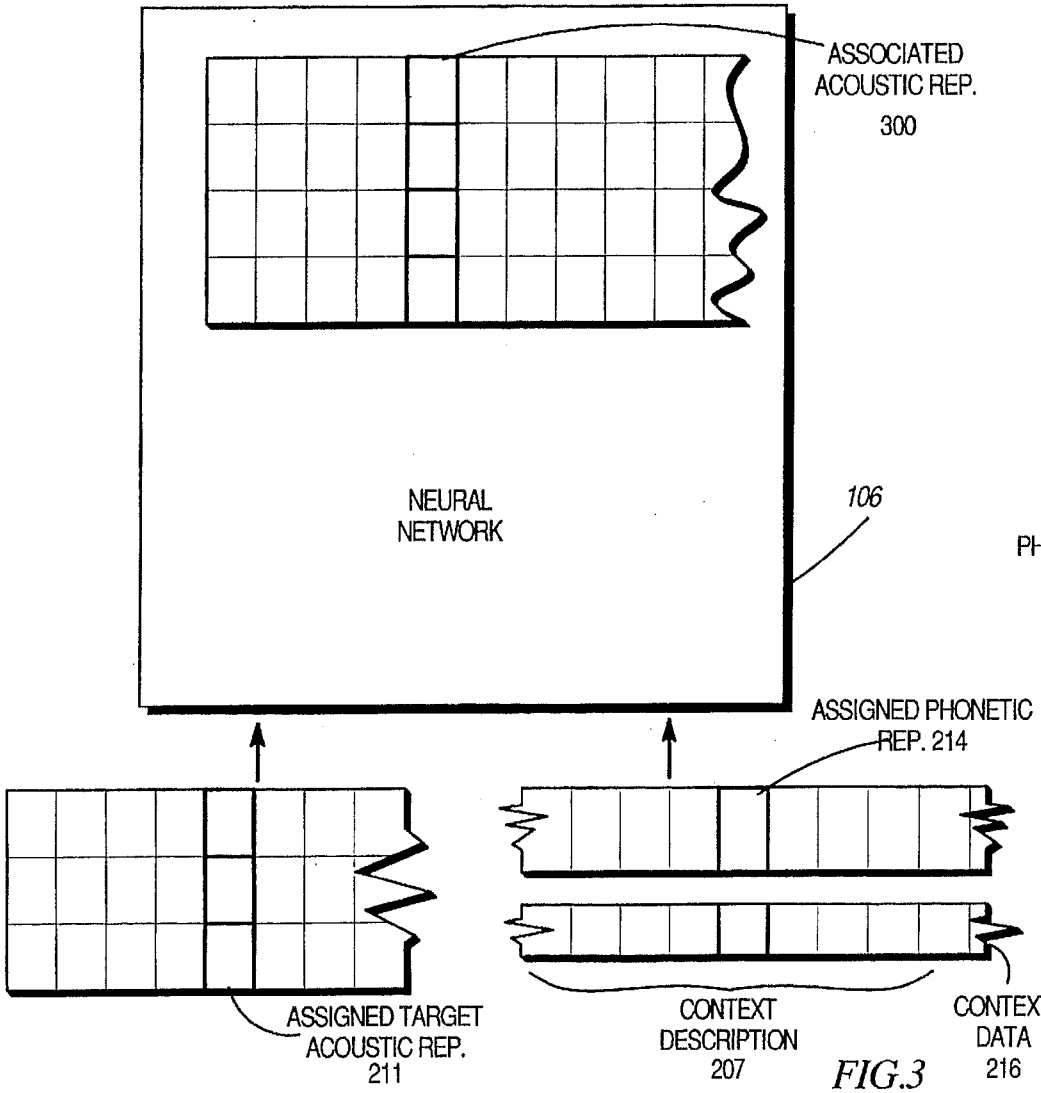
FIG. 3 illustrates a method for training a neural network in accordance with the present invention.

FIG. 3 illustrates the neural network training process that must occur to set-up the neural network 106 prior to normal operation. The neural network produces an output vector based on its input vector and the internal transfer functions used by the PEs. The coefficients used in the transfer functions are varied during the training process to vary the output vector. The transfer functions and coefficients are collectively referred to as the weights of the neural network 106, and the weights are varied in the training process to vary the output vector produced by a given input vector. The weights are set to small random values initially. The context description 207 serves as an input vector and is applied to the inputs of the neural network 106. The context description 207 is processed according to the neural network weight values to produce an output vector, i.e., the associated acoustic representation 300. At the beginning of the training session the associated acoustic representation 300 is not meaningful since the neural network weights are random values. An error signal vector is generated in proportion to the distance between the associated acoustic representation 300 and the assigned target acoustic representation 211. Then the weight values are adjusted in a direction to reduce this error signal. This process is repeated a number of times for the associated pairs of context descriptions 207 and assigned target acoustic representations 211. This process of adjusting the weights to bring the associated acoustic representation 300 closer to the assigned target acoustic representation 211 is the training of the neural network 106. This training uses the standard back propagation of errors method. Once the neural network 106 is trained, the weight values possess the information necessary to convert the context description 207 to an output vector similar in value to the assigned target acoustic representation 211. The preferred neural network implementation discussed above with reference to FIG. 1 requires up to ten million presentations of the context description 207 to its inputs and the following weight adjustments before it is considered to be fully trained.

Figure 4:
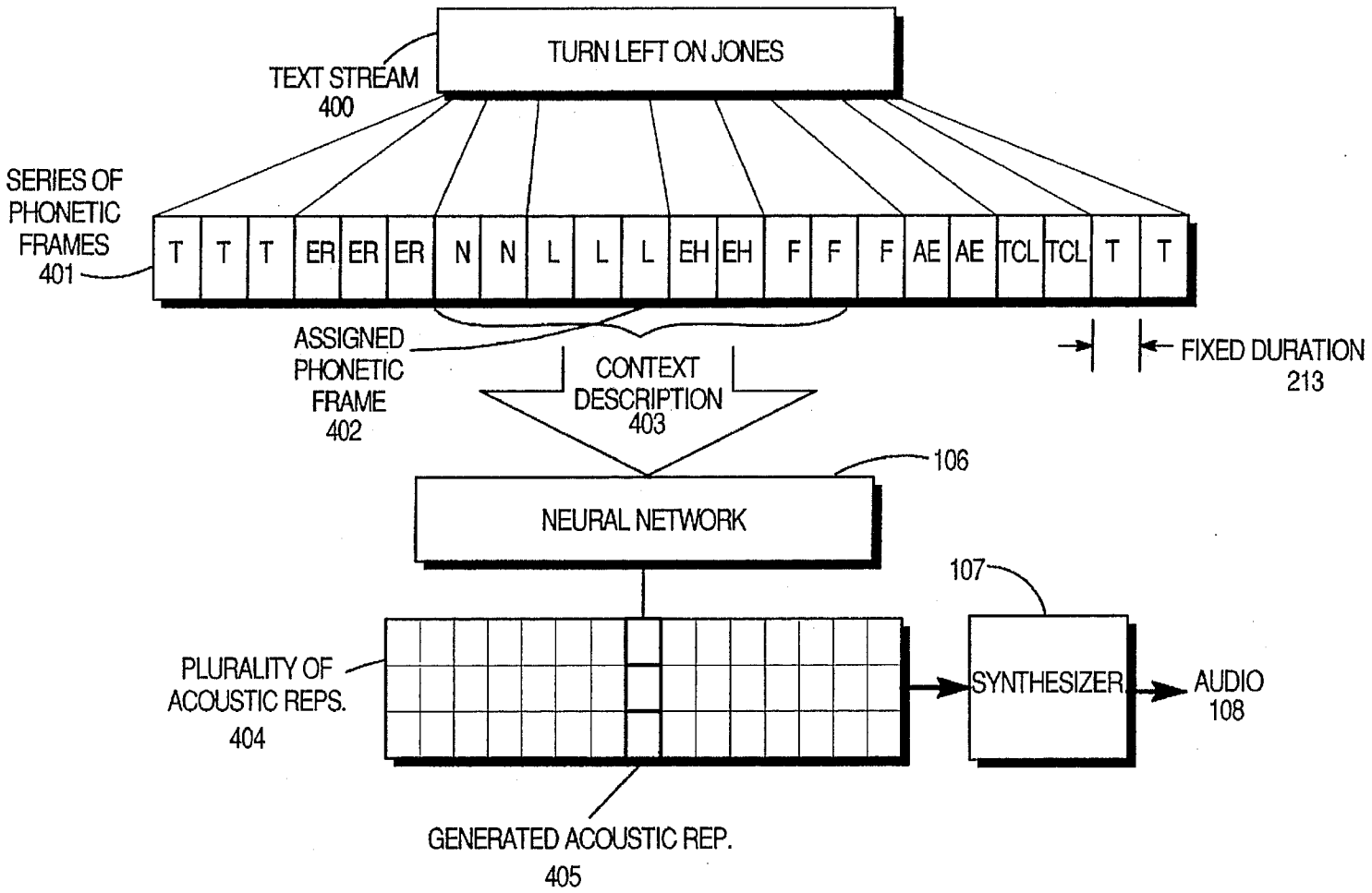
FIG. 4 illustrates a method for generating audio from a text stream in accordance with the present invention.

FIG. 4 illustrates how a text stream 400 is converted into audio during normal operation using a trained neural network 106. The text stream 400 is converted to a series of phonetic frames 401 having the fixed duration 213 where the representation of each frame is of the same type as the phonetic representations 203. For each assigned phonetic frame 402, a context description 403 is generated of the same type as the context description 207. This is provided as input to the neural network 106, which produces a generated acoustic representation 405 for the assigned phonetic frame 402. Performing the conversion for each assigned phonetic frame 402 in the series of phonetic frames 401 produces a plurality of acoustic representations 404. The plurality of acoustic representations 404 are provided as input to the synthesizer 107 to produce audio 108.

Figure 5:
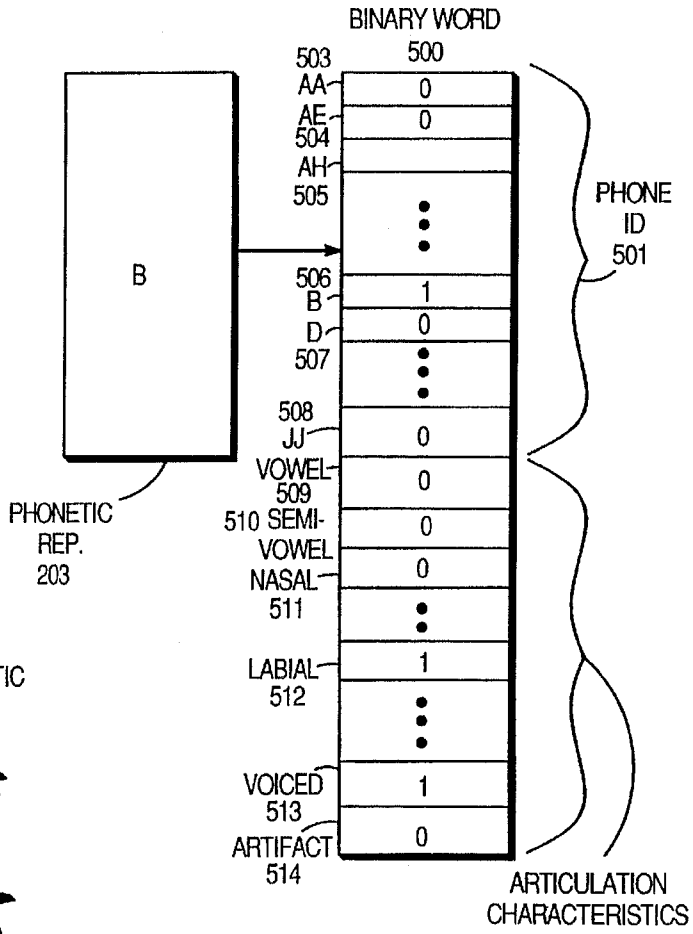
FIG. 5 illustrates a binary word that may be used as a phonetic representation of an audio frame in accordance with the present invention.

FIG. 5 illustrates a preferred implementation of a phonetic representation 203. The phonetic representation 203 for a frame consists of a binary word 500 that is divided into the phone ID 501 and the articulation characteristics 502. The phone ID 501 is simply a one-of-N code representation of the phone nominally being articulated during the frame. The phone ID 501 consists of N bits, where each bit represents a phone that may be uttered in a given frame. One of these bits is set, indicating the phone being uttered, while the rest are cleared. In FIG. 5, the phone being uttered is the release of a B, so the bit B 506 is set and the bits AA 503, AE 504, AH 505, D 507, JJ 508, and all the other bits in the phone ID 501 are cleared. The articulation characteristics 502 are bits that describe the way in which the phone being uttered is articulated. For example, the B described above is a voiced labial release, so the bits vowel 509, semivowel 510, nasal 511, artifact 514, and other bits that represent characteristics that a B release does not have are cleared, while bits representing the characteristics that a B release has, such as labial 512 an voiced 513, are set. In the preferred implementation, where there are 60 possible phones and 36 articulation characteristics, the binary word 500 is 96 bits.

The present invention provides a method for converting text into audible signals, such as speech. With such a method, a speech synthesis system is be trained to produce a speaker's voice automatically, without the tedious rule generation required by synthesis-by-role systems or the boundary matching and smoothing required by concatenation systems. This method provides an improvement over previous attempts to apply neural networks to the problem, as the context description used does not result in large changes at phonetic representation boundaries.

We claim:

1. A method for training and utilizing a neural network that is used to convert text streams into audible signals, the method comprising the steps of:

wherein training a neural network utilizes the steps of:

1a) inputting recorded audio messages;

1b) dividing the recorded audio messages into a series of audio frames, wherein each audio frame has a fixed duration;

1c) assigning, for each audio frame of the series of audio frames, a phonetic representation of a plurality of phonetic representations that include articulation characteristics;

1d) generating a context description of a plurality of context descriptions for each audio frame based on the phonetic representation of the each audio frame and the phonetic representation of at least some other audio frames of the series of audio frames, generating syntactic boundary information based on the phonetic representation of the audio frame and the phonetic representation of at least some other audio frames of the series of audio frames, generating phonetic boundary information based on the phonetic representation of the audio frame and the phonetic representation of at least some other audio frames of the series of audio frames, and generating a description of prominence of syntactic information based on the phonetic representation of the audio frame and the phonetic representation of at least some other audio frames of the series of audio frames;

1e) assigning, for the each audio frame, a target acoustic representation of a plurality of acoustic representations;

1f) training a feed-forward neural network with a recurrent input structure to associate an acoustic representation of the plurality of acoustic representations with the context description of the each audio frame, wherein the acoustic representation substantially matches the target acoustic representation;

wherein upon receiving a text stream, converting the text stream into an audible signal utilizing the steps of:

1g) converting the text stream into a series of phonetic frames, wherein a phonetic frame of the series of phonetic frames includes one of the plurality of phonetic representations, and wherein a phonetic frame has the fixed duration;

1h) assigning one of the plurality of context descriptions to the phonetic frame based on the one of the plurality of phonetic representations and phonetic representations of at least some other phonetic frames of the series of phonetic frames;

1i) converting, by the neural network, the phonetic frame into one of the plurality of acoustic representations, based on the one of the plurality of context descriptions; and 1j) converting the one of the plurality of acoustic representations into an audible signal.

2. The method of claim 1, wherein, in step (c) the phonetic representation includes a phone.

3. The method of claim 2, wherein, in step (c) the phonetic representation includes a binary word, where one bit of the binary word is set and any remaining bits of the binary word are not set to indicate that the phonetic representation is a phone.

4. The method of claim 1, wherein, in step (e) the plurality of acoustic representations are speech parameters.

5. The method of claim 1, wherein step (f) comprises training the neural network using back propagation of errors.

6. The method of claim 1, wherein, in step (g) the text stream is a phonetic form of a language.

7. A method for training and utilizing a neural network that is used to convert text streams into audible signals, the method comprising the steps of:

a) inputting recorded audio messages;

b) dividing the recorded audio messages into a series of audio frames, wherein each audio frame has a fixed duration;

c) assigning, for each audio frame of the series of audio frames, a phonetic representation of a plurality of phonetic representations;

d) generating a context description of a plurality of context descriptions for the each audio frame based on the phonetic representation of the each audio frame and the phonetic representation of at least some other audio frames of the series of audio frames;

e) assigning, for the each audio frame, a target acoustic representation of a plurality of acoustic representations;

f) training a neural network to associate an acoustic representation of the plurality of acoustic representations with the context description of the each audio frame, wherein the acoustic representation substantially matches the target acoustic representation, wherein training the neural network includes the steps of:

1a) inputting recorded audio messages;

2b) dividing the recorded audio messages into a series of audio frames, wherein each audio frame has a fixed duration;

1c) assigning, for each audio frame of the series of audio frames, a phonetic representation of a plurality of phonetic representations that include articulation characteristics:

1d) generating a context description of a plurality of context descriptions for each audio frame based on the phonetic representation of the each audio frame and the phonetic representation of at least some other audio frames of the series of audio frames, generating syntactic boundary information based on the phonetic representation of the audio frames and the phonetic representation of at least some other audio frames of the series of audio frames, generating phonetic boundary information based on the phonetic representation of the audio frame and the phonetic representation of at least some other audio frames of the series of audio frames, and generating a description of prominence of syntactic information based on the phonetic representation of the audio frame and the phonetic representation of at least some other audio frames of the series of audio frames;

1e) assigning for the each audio frame, a target acoustic representation of a plurality of acoustic representations;

2f) training a feed-forward neural network with a recurrent input structure to associate an acoustic representation of the plurality of acoustic representations with the context description of the each audio frame, wherein the acoustic representation substantially matches the taract acoustic representation;

wherein upon receiving a text stream, converting the text stream into an audible signal utilizing the steps of:

1g) converting the text stream into a series of phonetic frames, wherein a phonetic frame of the series of phonetic frames includes one of the plurality of phonetic representations, and wherein a phonetic frame has the fixed duration;

1h) assigning one of the plurality of context descriptions to the phonetic frame based on the one of the plurality of phonetic representations and phonetic representations of at least some other phonetic frames of the series of phonetic frames;

1i) converting, by the neural network, the phonetic frame into one of the plurality of acoustic representations, based on the one of the plurality of context descriptions; and 1j) converting the one of the plurality of acoustic representations into an audible signal.

8. The method of claim 7, wherein, in step (c) the phonetic representation includes a phone.

9. The method of claim 8, wherein, in step (c) the phonetic representation includes a binary word, where one bit of the binary word is set and any remaining bits of the binary word are not set to indicate that the phonetic representation is a phone.

10. The method of claim 7, wherein, in step (e) the phonetic representation includes articulation characteristics.

11. The method of claim 7, wherein, in step (f) the plurality of acoustic representations are speech parameters.

12. The method of claim 7, wherein, in step (f) the neural network is a feed-forward neural network.

13. The method of claim 7, wherein step (f) comprises training the neural network using back propagation of errors.

14. The method of claim 7, wherein, in step (f) the neural network has a recurrent input structure.

15. The method of claim 7, wherein step (d) further comprises generating syntactic boundary information based on the phonetic representation of the audio frame and the phonetic representation of at least some other audio frames of the series of audio frames.

16. The method of claim 7, wherein step (d) further comprises generating phonetic boundary information based on the phonetic representation of the audio frame and the phonetic representation of at least some other audio frames of the series of audio frames.

17. The method of claim 7, wherein step (d) further comprises generating a description of prominence of syntactic information based on the phonetic representation of the audio frame and the phonetic representation of at least some other audio frames of the series of audio frames.

18. A method for training and utilizing a neural network that is used to convert text streams into audible signals, the method comprising the steps of:

a) receiving a text stream;

b) converting the text stream into a series of phonetic frames, wherein a phonetic frame of the series of phonetic frames includes one of a plurality of phonetic representations, and wherein the phonetic frame has a fixed duration;

c) assigning one of a plurality of context descriptions to the phonetic frame based on one of the plurality of phonetic representations and phonetic representations of at least some other phonetic frames of the series of phonetic frames;

d) converting, by a neural network, the phonetic frame into one of a plurality of acoustic representations, based on the one of the plurality context descriptions, wherein training the neural network includes the steps of:

d1) inputting recorded audio messages;

d2) dividing the recorded audio messages into a series of audio frames wherein each audio frame has a fixed duration;

d3) assigning, for each audio frame of the series of audio frames, a phonetic representation of a plurality of phonetic representations that include articulation characteristics;

d4) generating a context description of a plurality of context descriptions for each audio frame based on the phonetic representation of the each audio frames and the phonetic representation of at least some other audio frames of the series of audio frames, generating syntactic boundary information based on the phonetic representation of the audio frame and the phonetic representation of at least some other audio frames of the series of audio frames, generating phonetic boundary information based on the phonetic representation of the audio frame and the phonetic representation of at least some other audio frames of the series of audio frames, and generating a description of prominence of syntactic information based on the phonetic representation of the audio frame and the phonetic representation of at least some other audio frames of the series of audio frames;

d5) assigning, for the each audio frame, a target acoustic representation of a plurality of acoustic representations;

d6) training a feed-forward neural network with a recurrent input structure to associate an acoustic representation of the plurality of acoustic representations with the context description of the each audio frame, wherein the acoustic representation substantially matches the target acoustic representation;

wherein upon receiving a text stream, converting the text stream into an audible signal utilizing the steps of:

d7) converting the text stream into a series of phonetic frames, wherein a phonetic frame of the series of phonetic frames includes one of the plurality of phonetic representations, and wherein a phonetic frame has the fixed duration;

d8) assigning one of the plurality of context descriptions to the phonetic frame based on the one of the plurality of phonetic representations and phonetic representations of at least some other phonetic frames of the series of phonetic frames;

d9) converting, by the neural network, the phonetic frame into one of the plurality of acoustic representations, based on the one of the plurality of context descriptions; and e) converting the one of the plurality of acoustic representations into an audible signal.

19. The method of claim 18, wherein, in step (b) the phonetic representation includes a phone.

20. The method of claim 19, wherein, in step (b) the phonetic representation includes a binary word, where one bit of the binary word is set and any remaining bits of the binary word are not set to indicate that the phonetic representation is a phone.

21. The method of claim 18, wherein, in step (b) the phonetic representation includes articulation characteristics.

22. The method of claim 18, wherein, in step (d) the plurality of acoustic representations are speech parameters.

23. The method of claim 18, wherein, in step (d) the neural network is a feed-forward neural network.

24. The method of claim 18, wherein, in step (d) the neural network has a recurrent input structure.

25. The method of claim 18, wherein step (c) further comprises generating syntactic boundary information based on the phonetic representation of an audio frame and a phonetic representation of at least some other audio frames of the series of audio frames.

26. The method of claim 18, wherein step (c) further comprises generating phonetic boundary information based on the phonetic representation of an audio frame and a phonetic representation of at least some other audio frames of the series of audio frames.

27. The method of claim 18, wherein step (c) further comprises generating a description of prominence of syntactic information based on the phonetic representation of an audio frame and a phonetic representation of a least some other audio frames of the series of audio frames.

28. The method of claim 18, wherein, in step (a) the text stream is a phonetic form of a language.

29. A device for converting text into audible signals comprising:

a text-to-phone processor, wherein the text-to-phone processor translates a text stream into a series of phonetic representations;

a duration processor, operably coupled to the text-to-phone processor, wherein the duration processor generates duration data for the text stream;

a pre-processor, wherein the pre-processor converts the series of phonetic representations and the duration data into a series of phonetic frames, wherein each phonetic frame of the series of phonetic frames is of a fixed duration and has a context description, and wherein the context description is based on each phonetic frame of the series of phonetic frames and at least some other phonetic frame of the series of phonetic frames; and a neural network, which can be trained, which generates an acoustic representation for each phonetic frame of the series of phonetic frames based on the context description, wherein training the neural network includes the steps of:

a) inputting recorded audio messages;

b) dividing the recorded audio messages into a series of audio frames, wherein each audio frame has a fixed duration;

c) assigning, for each audio frame of the series of audio frames, a phonetic representation of a plurality of phonetic representations that include articulation characteristics;

d) generating a context description of a plurality of context descriptions for each audio frame based on the phonetic representation of the each audio frame and the phonetic representation of at least some other audio frames of the series of audio frames, generating syntactic boundary information based on the phonetic representation of the audio frame and the phonetic representation of at least some other audio frames of the series of audio frames, generating phonetic boundary information based on the phonetic representation of the audio frame and the phonetic representation of at least some other audio frames of the series of audio frames, and generating a description of prominence of syntactic information based on the phonetic representation of the audio frame and the phonetic representation of at least some other audio frames of the series of audio frames;

e) assigning, for the each audio frame, a target acoustic representation of a plurality of acoustic representations;

f) training a feed-forward neural network with a recurrent input structure to associate an acoustic representation of the plurality of acoustic representations with the context description of the each audio frame, wherein the acoustic representation substantially matches the target acoustic representation;

wherein upon receiving a text stream, converting the text stream into an audible signal utilizing the steps of:

g) converting the text stream into a series of phonetic frames, wherein a phonetic frame of the series of phonetic frames includes one of the plurality of phonetic representations, and wherein a phonetic frame has the fixed duration;

h) assigning one of the plurality of context descriptions to the phonetic frame based on the one of the plurality of phonetic representations and phonetic representations of at least some other phonetic frames of the series of phonetic frames;

i) converting, by the neural network, the phonetic frame into one of the plurality of acoustic representations, based on the one of the plurality of context descriptions; and j) converting the one of the plurality of acoustic representations into an audible signal.

30. The device of claim 29 further comprising:

a synthesizer, operably connected to the neural network, that produces an audible signal in response to the acoustic representation.

31. A speech synthesizing device within a vehicular navigation system to generate an audible output to a driver of a vehicle comprising:

a directional database consisting of a plurality of text streams;

a text-to-phone processor, operably coupled to the directional database, wherein the text-to-phone processor translates a text stream of the plurality of text streams into a series of phonetic representations;

a duration processor, operably coupled to the text-to-phone processor, wherein the duration processor generates duration data for the text stream;

a pre-processor, wherein the pre-processor converts the series of phonetic representations and the duration data into a series of phonetic frames, wherein each phonetic frame of the series of phonetic frames is of a fixed duration and has a context description, and wherein the context description is based on the each phonetic frame of the series of phonetic frames and at least some other phonetic frame of the series of phonetic frames;

a neural network, which can be trained, which generates an acoustic representation for a phonetic frame of the series of phonetic frames based on the context description, wherein training the neural network includes the steps of:

a) inputting recorded audio messages;

b) dividing the recorded audio messages into a series of audio frames, wherein each audio frame has a fixed duration;

c) assigning, for each audio frame of the series of audio frames, a phonetic representation of a plurality of phonetic representations that include articulation characteristics;

d) generating a context description of a plurality of context descriptions for each audio frame based on the phonetic representation of the each audio frame and the phonetic representation of at least some other audio frames of the series of audio frames, generating syntactic boundary information based on the phonetic representation of the audio frame and the phonetic representation of at least some other audio frames of the series of audio frames, generating phonetic boundary information based on the phonetic representation of the audio frame and the phonetic representation of at least some other audio frames of the series of audio frames, and generating a description of prominence of syntactic information based on the phonetic representation of the audio frame and the phonetic representation of at least some other audio frames of the series of audio frames;

e) assigning, for the each audio frame, a target acoustic representation of a plurality of acoustic representations;

f) training a feed-forward neural network with a recurrent input structure to associate an acoustic representation of the plurality of acoustic representations with the context description of the each audio frame, wherein the acoustic representation substantially matches the target acoustic representation;

wherein upon receiving a text stream, converting the text stream into an audible signal utilizing the steps of:

g) converting the text stream into a series of phonetic frames, wherein a phonetic frame of the series of phonetic frames includes one of the plurality of phonetic representations, and wherein a phonetic frame has the fixed duration;

h) assigning one of the plurality of context descriptions to the phonetic frame based on the one of the plurality of phonetic representations and phonetic representations of at least some other phonetic frames of the series of phonetic frames;

i) converting, by the neural network, the phonetic frame into one of the plurality of acoustic representations, based on the one of the plurality of context descriptions; and j) converting the one of the plurality of acoustic representations into an audible signal.

32. The vehicular navigation system of claim 31 further comprising:

a synthesizer, operably connected to the neural network, that produces an audible signal in response to the acoustic representation.

* * * * *

UNITED STATES PATENT AND TRADEMARK OFFICE

CERTIFICATE OF CORRECTION

PATENT NO. : 5,668,926

DATED : September 16, 1997

INVENTOR(S) : Karaali et al.

It is certified that error appears in the above-indentified patent and that said Letters Patent is hereby corrected as shown below:

Col. 21, line 38, "2b" should be --1b--
Col. 21, line 66, "2f" should be --1f--
Col. 22, line 4, "taract" should be --target--

Signed and Sealed this

Seventeenth Day of March, 1998

*Attest:*

*Attesting Officer*

BRUCE LEHMAN

*Commissioner of Patents and Trademarks*